US008279036B2

(12) United States Patent
Banno

(10) Patent No.: US 8,279,036 B2
(45) Date of Patent: Oct. 2, 2012

(54) MULTILAYER COIL DEVICE

(75) Inventor: Yoshiko Banno, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/879,680

(22) Filed: Sep. 10, 2010

(65) Prior Publication Data

US 2011/0074535 A1 Mar. 31, 2011

(30) Foreign Application Priority Data

Sep. 29, 2009 (JP) ..... 2009-224882

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 7,705,704 B2 * 4/2010 Lee et al. ..... 336/200

FOREIGN PATENT DOCUMENTS

| | | |
|---|---|---|
| JP | 62-107409 | 5/1987 |
| JP | 04-134807 | 5/1992 |
| JP | 2002-523896 A | 7/2002 |
| JP | 2003-158015 A | 5/2003 |
| JP | 2005-109097 A | 4/2005 |
| KR | 10-0863889 | 10/2008 |

OTHER PUBLICATIONS

English translation of JP2005109097.*
Korean Office Action dated Aug. 23, 2011; Korean Patent Application No. 2010-0077648 with abstract.
Korean Office Action issued on Mar. 27, 2012; Korean Patent Application No. 2010-77648; with English abstract.

* cited by examiner

*Primary Examiner* — Mohamad Musleh
*Assistant Examiner* — Ronald Hinson
(74) *Attorney, Agent, or Firm* — Studebaker & Brackett PC; Tim L. Brackett, Jr.; John F. Guay

(57) ABSTRACT

A multilayer coil device is formed by alternately stacking a plurality of insulating layers and a plurality of substantially spiral coil patterns. In the multilayer coil device, the number of turns of each of the substantially spiral coil patterns is more than one. Each of the substantially spiral coil patterns has a protrusion protruding toward a center of the substantially spiral coil pattern. The protrusion is located in a specific region where the number of coil pattern portions that cross a virtual line extending radially outward from the center of the coil pattern is smaller than that in another region of the substantially spiral coil pattern. The protrusion is provided as an additional part of a coil pattern portion that is closest to the center of the substantially spiral coil pattern in the specific region.

3 Claims, 5 Drawing Sheets

MULTILAYER COIL DEVICE

CROSS REFERENCE TO RELATED APPLICATIONS

The present application claims priority to Japanese Patent Application No. 2009-224882, which was filed on Sep. 29, 2009, the entire contents of which is incorporated herein by reference in their entirety.

FIELD OF THE INVENTION

The present invention relates to multilayer coil devices formed by alternately stacking insulating layers and substantially spiral coil patterns. In particular, the present invention relates to multilayer coil devices, such as multilayer power inductors, multilayer common-mode choke coils, and high-frequency multilayer inductors.

BACKGROUND

Examples of multilayer coil devices of the above-described type include a multilayer inductor described in Japanese Unexamined Patent Application Publication No. 2005-109097. This multilayer inductor is formed by alternately stacking insulating layers and substantially spiral coil patterns. With the multilayered coil patterns having multiple turns, this multilayer inductor achieves higher inductance.

However, in the multilayer inductor described above, the higher inductance results in a longer coil length, which may lead to increased direct-current resistance.

If the line width of the entire coil patterns is increased to reduce the direct-current resistance, the following problems may arise.

FIG. 4 is an exploded perspective view diagram of a known multilayer coil device 11 having a multilayer body 12 including insulating layers 141-145 alternately stacked with electrically conductive spiral coil patterns 151-154. End portions 151*b*, 152*a*, 152*b*, 153*a*, 153*b*, 154*a* of the coil patters are connected via through holes (not shown) in the insulating layers 152, 153 and 154. Extraction electrodes 161 and 162 are connected to ends of respective coil patterns 151 and 154. External electrodes 13-1 and 13-2 of the multilayer coil device 1 are respectively connected to extraction electrodes 161 and 162. FIG. 5 shows a plan view of a coil pattern 152 on insulating layer 142 of the known multilayer coil device 1 shown in FIG. 4. In a multilayer inductor, such as that illustrated in FIG. 4 and FIG. 5, increasing the line width of coil patterns reduces an inside diameter area S of a coil part and a width of a side gap G. This may reduce an inductance value or cause deterioration of direct-current superimposition characteristics.

Additionally, since the coil patterns are substantially spiral in shape, if, for example, a sheet lamination technique is used as a production method, the coil patterns may be deformed by smearing during screen printing or by pressure applied thereto during stamping. This may cause short circuits between lines of the coil patterns.

SUMMARY

The present invention is directed to a multilayer coil device that addresses the problems described above, and can achieve lower direct-current resistance.

A multilayer coil device consistent with the claimed invention includes a multilayer body and a pair of external electrodes.

The multilayer body includes a plurality of insulating layers, a coil part composed of a plurality of substantially spiral coil patterns, and a pair of extraction electrodes connected to both ends of the coil part. The multilayer body is formed by alternately stacking the insulating layers and the coil patterns.

The external electrodes are formed on both end faces of the multilayer body and electrically connected to the respective extraction electrodes.

In the multilayer coil device, the number of turns of each of the coil patterns is more than one. Each of the substantially spiral coil patterns has a protrusion located in a specific region where a number of coil pattern portions that cross a virtual line extending radially outward from a center of the coil pattern is smaller than that in another region of the substantially spiral coil patter. The protrusion is provided as an additional part of a specific coil pattern portion that is closest to the center of the substantially spiral coil pattern in the specific region. The protrusion protrudes toward the center of the coil pattern such that a line width of the specific coil pattern portion is larger than that of other coil pattern portions in the other region of the substantially spiral coil pattern.

With the present invention, where it is not necessary to change the line width of the entire coil patterns, an inside diameter area of the coil part and a width of a side gap can be maintained. Therefore, with the present invention, it is possible to reduce direct-current resistance while maintaining an inductance value of the coil part and the performance of direct-current superimposition characteristics.

Additionally, even when a sheet lamination technique is used as a production method, it is possible to prevent short circuits between lines of the coil patterns.

Other features, elements, characteristics and advantages of the present invention will become more apparent from the following detailed description of preferred embodiments of the present invention with reference to the attached drawings.

BRIEF DESCRIPTION OF THE DRAWINGS

FIGS. 3A to FIG. 3D are plan views illustrating exemplary modifications of a coil pattern.

DETAILED DESCRIPTION

Exemplary embodiments of a multilayer coil device will now be described.

Figure 1:
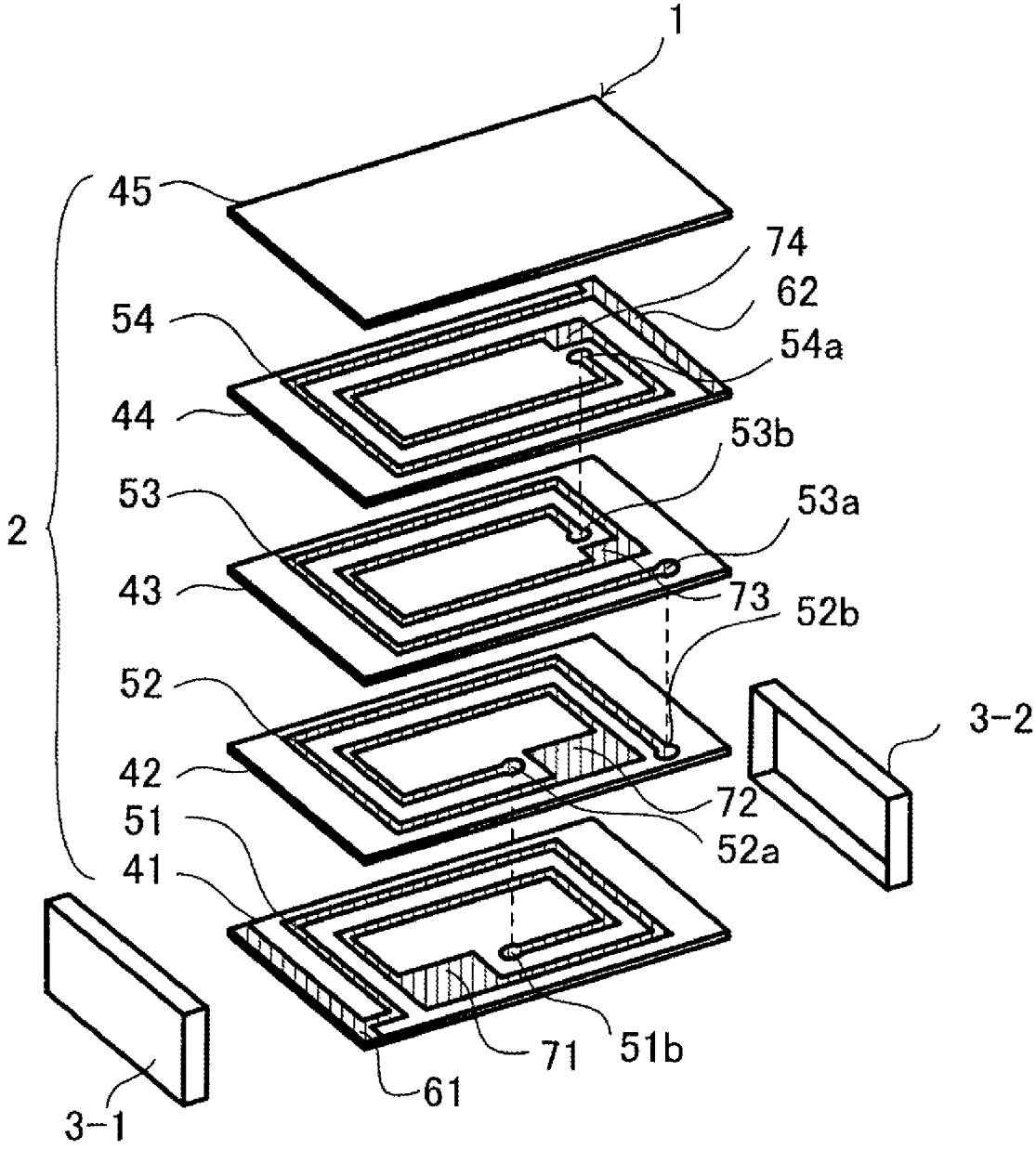
FIG. 1 is an exploded perspective view of a multilayer coil device according to an exemplary embodiment.

FIG. 1 is an exploded perspective view of a multilayer coil device according to an exemplary embodiment (first embodiment) of the present invention.

As illustrated in FIG. 1, a multilayer coil device 1 of the first embodiment includes a multilayer body 2 and a pair of external electrodes 3-1 and 3-2.

The multilayer body 2 is formed by alternately stacking insulating layers 41 to 45 and electrically conductive coil patterns 51 to 54.

More specifically, the coil pattern 51 and an extraction electrode 61 are disposed on the insulating layer 41 at the bottom. The insulating layer 42 is disposed on the coil pattern 51 and the extraction electrode 61, and the coil pattern 52 is disposed on the insulating layer 42. The insulating layer 43, the coil pattern 53, the insulating layer 44, the coil pattern 54, and an extraction electrode 62 are sequentially provided, or disposed on the coil pattern 52. Then, the insulating layer 45 is provided on top of them to form the multilayer body 2.

An end portion 51*b* of the coil pattern 51 and an end portion 52*a* of the coil pattern 52, an end portion 52*b* of the coil pattern 52 and an end portion 53*a* of the coil pattern 53, and an end portion 53*b* of the coil pattern 53 and an end portion 54*a* of the coil pattern 54 are electrically connected to each other through respective through holes (not shown) in the insulating layers 42, 43, and 44. Thus, a substantially spiral multilayered coil part with multiple turns can be obtained.

The coil patterns 51 and 54 are electrically connected to the extraction electrodes 61 and 62, respectively. The extraction electrodes 61 and 62 are electrically connected to the external electrodes 3-1 and 3-2, respectively.

The coil patterns 51 to 54 of the first embodiment have coil pattern protrusions 71 to 74, respectively.

The coil pattern protrusions 71 to 74 will be described in detail with reference to FIG. 2.

Figure 2:
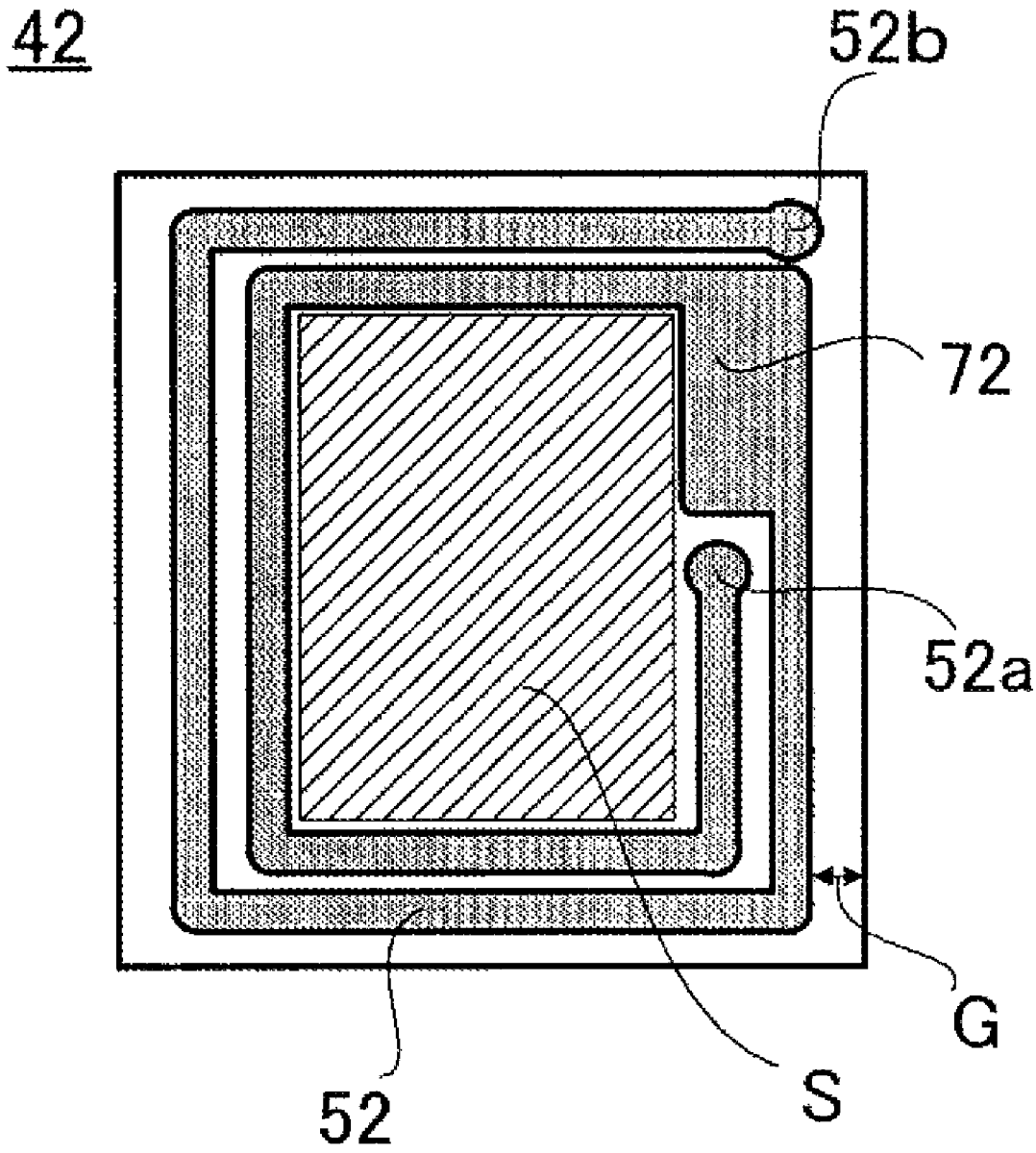
FIG. 2 is a plan view of a coil pattern on an insulating layer according to the embodiment shown in FIG. 1.
Figure 3A:
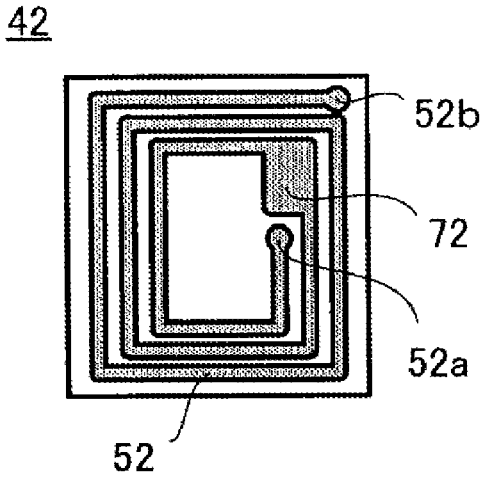
Figure 3A:
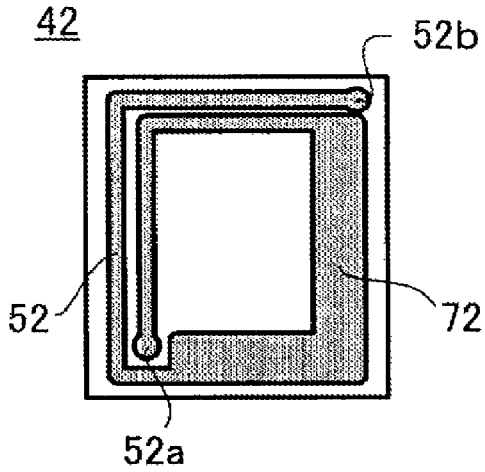
Figure 3C:
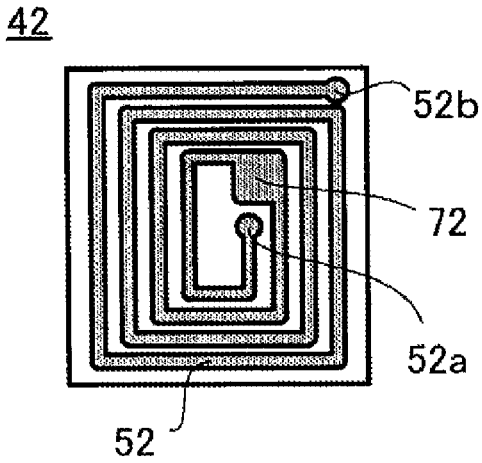
Figure 3D:
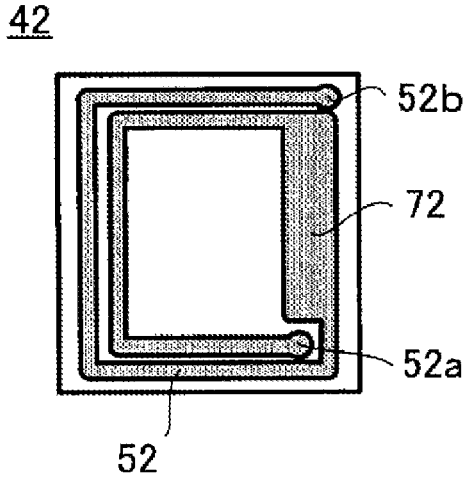
Figure 4:
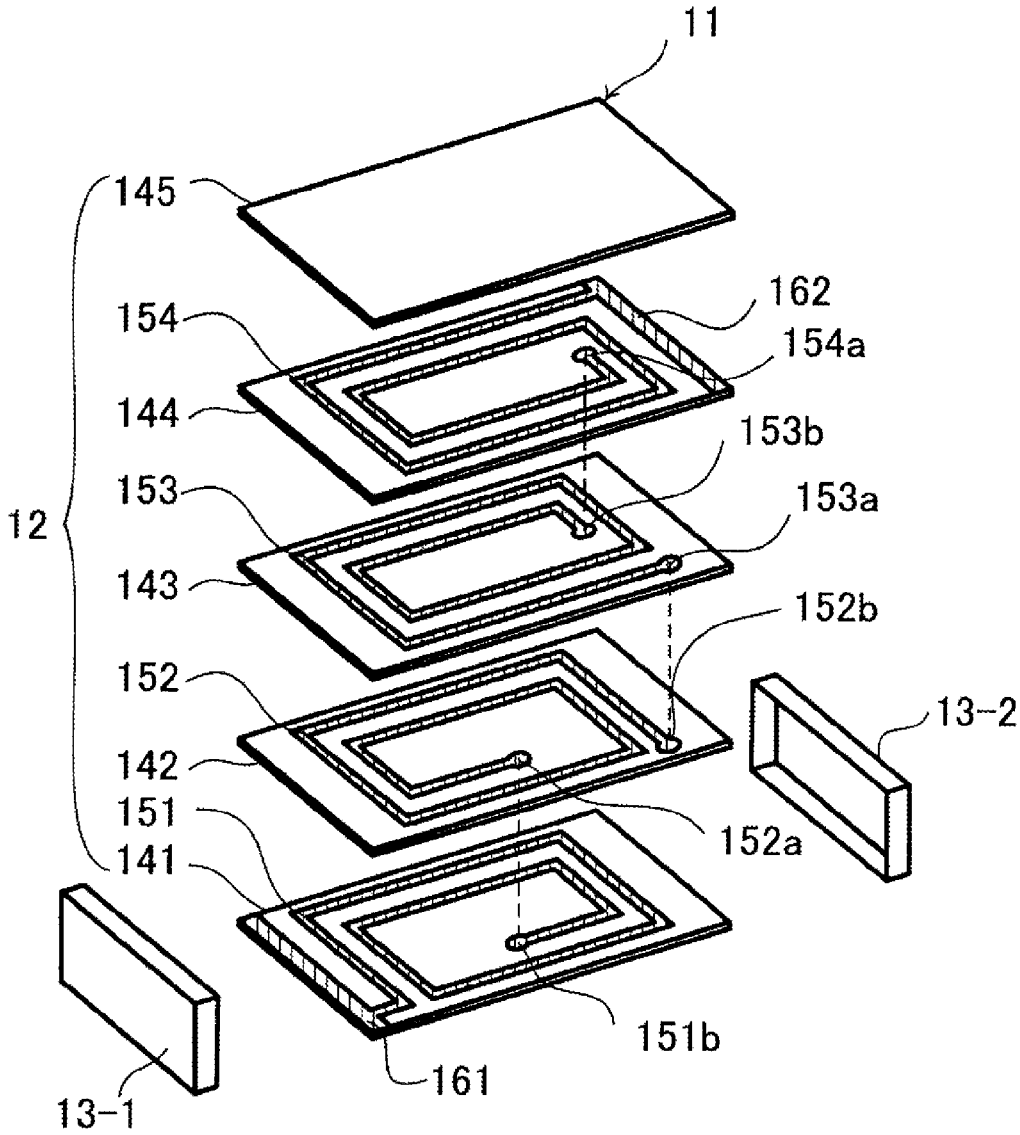
Fig. 4 Prior Art
FIG. 4 is an exploded perspective view of a known multilayer coil device.
Figure 5:
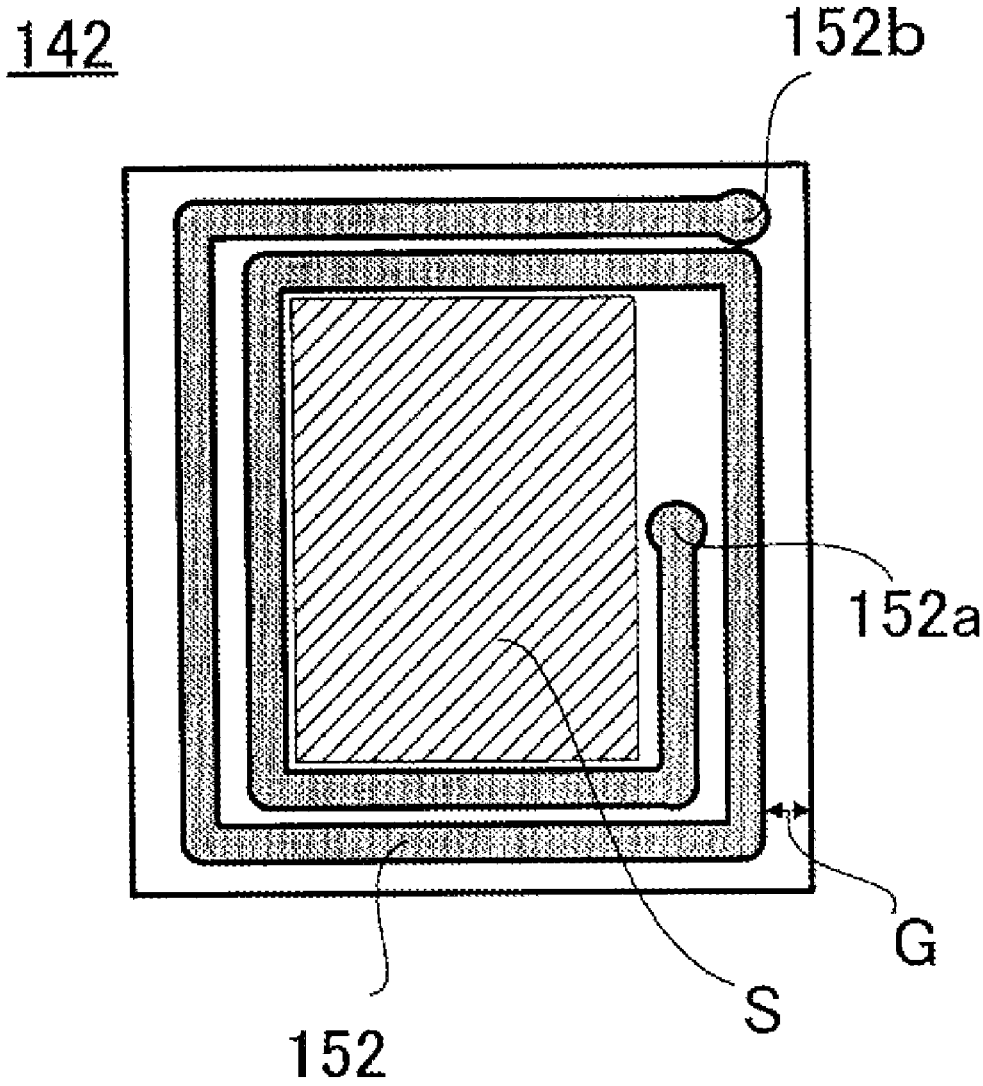
Fig. 5 Prior Art
FIG. 5 is a plan view of a coil pattern on an insulating layer of the known multilayer coil device.

FIG. 2 is a plan view of the coil pattern 52 on the insulating layer 42 according to the first exemplary embodiment.

The coil pattern 52 on the insulating layer 42 is a substantially spiral pattern with about one and seven-eighths turns.

The coil pattern 52 has the coil pattern protrusion 72.

The coil pattern protrusion 72 is located in a specific region of the spiral coil pattern 52 where the number of coil pattern portions that cross a virtual line extending radially outward from a center of the substantially spiral coil pattern 52 is smaller than that in another region of the spiral coil pattern 52. The coil pattern protrusion 72 is provided as an additional part of a specific coil pattern portion that is closest to the center of the coil pattern 52 in the specific region.

Since the coil pattern protrusion 72 protrudes toward the center of the substantially spiral coil pattern 52, the line width of this specific coil pattern portion is larger than that of the other coil pattern portions in the coil pattern 52.

In the first exemplary embodiment, the multilayer coil device 1 has a substantially spiral coil part formed by stacking substantially double spiral coil patterns. In this structure, in a region where the number of coil pattern portions that cross a virtual line extending radially outward from a center of a substantially spiral coil pattern is smaller than that in the other region, an area inside a coil pattern portion that is closest to the center of the coil pattern is a dead space.

More specifically, as viewed from the top surface of the multilayer body 2 (i.e., as viewed from above the insulating layer 45 of FIG. 1) through the coil patterns 51, 52, 53, and 54, an inside diameter area of the coil part corresponds to, for example, an inside diameter area S illustrated in FIG. 2. This area determines an inductance value and performance of direct-current superimposition characteristics of the multilayer coil device 1 of the present invention. In contrast, a dead space, such as that described above, has less impact on the inductance value and the performance of direct-current superimposition characteristics.

Since a coil pattern protrusion, such as that described above, is provided in the dead space, it is possible in the present invention to reduce the direct-current resistance of the entire coil part. Even with the coil pattern protrusion, it is still possible to maintain the inductance value and the direct-current superimposition characteristics of the coil part.

In the first embodiment described above, the spiral of each of the coil patterns 51 to 54 has more than one turn, more specifically, about one and seven-eighths turns. However, the coil pattern 52 can be a coil pattern with a different number of turns, for example, about two and seven-eighths turns, about three and seven-eighths turns, about one and a half turns, or about one and three-fourths turns, as illustrated in FIG. 3A, FIG. 3B, FIG. 3C, and FIG. 3D, respectively. In each of these exemplary cases, the coil pattern 52 has the coil pattern protrusion 72 as illustrated in the drawings.

While the above description discusses exemplary coil pattern protrusions 72 of respective exemplary coil patterns 52 on the insulating layer 42, the same can apply to the coil pattern protrusions 71, 73, and 74 of the coil patterns 51, 53, and 54, respectively.

While preferred embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. A multilayer coil device comprising:

a multilayer body including a plurality of insulating layers, a coil part composed of a plurality of substantially spiral coil patterns, and a pair of extraction electrodes connected to both ends of the coil part, the multilayer body being formed by alternately stacking the insulating layers and the coil patterns; and a pair of external electrodes formed on both end faces of the multilayer body and electrically connected to the respective extraction electrodes, wherein the number of turns of each of the substantially spiral coil patterns is more than one, each of the substantially spiral coil patterns has a protrusion located in a specific region of the substantially spiral coil pattern where a number of coil pattern portions of the substantially spiral coil pattern that cross a virtual line extending radially outward from a center of the coil pattern is smaller than that in another region of the substantially spiral coil pattern, the protrusion is provided as an additional part of a specific coil pattern portion that is closest to the center of the substantially spiral coil pattern in the specific region, the protrusion protrudes toward the center of the substantially spiral coil pattern such that a line width of the specific coil pattern portion is larger than that of other coil pattern portions in the other region of the substantially spiral coil pattern, and the protrusion has a line width larger than a line width of the coil pattern directly adjacent to an end portion of the substantially spiral coil pattern.

2. The multilayer coil device of claim 1, wherein each said substantially spiral coil pattern has an inside diameter area having a substantially polygonal shape with a periphery defined in part by the protrusion.

3. A multilayer coil device, comprising:

a multilayer body including a plurality of insulating layers, a coil part composed of a plurality of substantially spiral coil patterns, and a pair of extraction electrodes connected to both ends of the coil part, the multilayer body being formed by alternately stacking the insulating layers and the coil patterns; and a pair of external electrodes formed on both end faces of the multilayer body and electrically connected to the respective extraction electrodes, wherein the number of turns of each of the substantially spiral coil patterns is more than one, each of the substantially spiral coil patterns has a protrusion located in a specific region of the substantially spiral coil pattern where a number of coil pattern portions of the substantially spiral coil pattern that cross a virtual line extending radially outward from a center of the coil pattern is smaller than that in another region of the substantially spiral coil pattern, the protrusion is provided as an additional part of a specific coil pattern portion that is closest to the center of the substantially spiral coil pattern in the specific region, the protrusion protrudes toward the center of the substantially spiral coil pattern such that a line width of the specific coil pattern portion is larger than that of other coil pattern portions in the other region of the substantially spiral coil pattern; and each substantially spiral coil pattern has an end portion connected to an end portion of another substantially spiral coil pattern, said end portion provided adjacent to a side portion of the protrusion that does not face the center of the substantially spiral coil pattern.

* * * * *